United States Patent [19]

Miltenberger

[11] 4,014,683

[45] Mar. 29, 1977

[54] METHOD OF MAKING DRAWING QUALITY STEEL

[75] Inventor: Robert S. Miltenberger, Weirton, W. Va.

[73] Assignee: National Steel Corporation, Pittsburgh, Pa.

[22] Filed: Dec. 23, 1974

[21] Appl. No.: 535,213

[52] U.S. Cl. ..... 75/49; 75/58; 75/123 R; 164/55

[51] Int. Cl.² ..... C21C 7/00

[58] Field of Search ..... 75/123 R, 49, .5, 58, 75/53, 57, 45; 148/31.5; 164/55, 56

[56] References Cited

UNITED STATES PATENTS

| | | | |
|---|---|---|---|
| 3,368,886 | 2/1968 | Muta et al. | 75/123 R |
| 3,387,967 | 6/1968 | Perry et al. | 75/49 |
| 3,412,781 | 11/1968 | Richards | 75/123 R |
| 3,459,537 | 8/1969 | Hornak | 75/49 |
| 3,702,243 | 11/1972 | Miltenberger | 75/49 |
| 3,792,999 | 2/1974 | Ruttiger | 75/49 |
| 3,793,000 | 2/1974 | Miltenberger | 75/49 |

*Primary Examiner*—Walter R. Satterfield
*Attorney, Agent, or Firm*—Shanley, O'Neil and Baker

[57] ABSTRACT

Drawing Quality steel having low carbon, oxygen, and aluminum contents is produced through the use of continuous casting. After tapping steel of the lowest possible carbon content at 2,960° F., predetermined amounts of manganese and aluminum are added to the ladle. The amount of manganese added is such that the manganese content at the conclusion of the process will be in the range of 0.20 to 0.35%. The amount of aluminum added is of small quantity for purposes of removing some of the oxygen from the steel to prevent boiling on refractories due to excessive oxygen; the aluminum added is consumed in deoxidation so that the aluminum content in the steel is not increased at that stage. After the addition of manganese and aluminum the steel is vacuum degassed. During vacuum degassing, predetermined amounts of carbon and aluminum which are mixed in briquette form are added at a predetermined, controlled rate to complete deoxidation. However, less aluminum is added to ensure that the aluminum content of the steel will be less than 0.023% and preferably less than 0.015%, thus enabling the steel to be continuously cast. The carbon is added to compensate for the decreased aluminum addition in the overall deoxidation process. However, the amount of added carbon is specifically limited so that after degassing the carbon content will still be less than 0.02%.

12 Claims, No Drawings

METHOD OF MAKING DRAWING QUALITY STEEL

BACKGROUND OF INVENTION

Drawing Quality steel has, of course, good drawability usually derived from the low carbon content of the steel. In one current practice of producing Drawing Quality steel for galvanized sheet to be used for example, in the automotive industry, the steel upon production is poured into ingots and slabs are formed at an ingot-to-slab efficiency of about 90%. If the steel were continuously cast, rather than poured into ingots, the efficiency could be improved to 95%. In addition, it would result in better drawing performance because often the ingot product suffers breakage in the draw press due to localized stringer-type inclusions which are far less prevalent in a low oxygen content, continuously cast steel product.

It is now known that in order to continuously cast steel, the oxygen content must be sufficiently low, below 125 parts per million, and preferably below 100 parts per million to avert formation of blow holes at and near the surface of the continuously cast slab, which blow holes result in surface defects, such as lines and silvers in the sheet product to be formed. It therefore has been necessary to deoxidize the steel such as through the addition of aluminum and/or silicon such as, for example, disclosed in my U.S. Pat. No. 3,702,243, issued Nov. 7, 1972 and No. 3,793,000, issued February 19, 1974 and both assigned to the assignee of the subject application; and U.S. Pat. No. 3,459,537 to Hornak, issued Aug. 5, 1969. However, it has been found that certain additives of the prior art create a problem in achieving the required grain size of 8 or 9 for Drawing Quality steel to be treated in a continuous galvanizing line. Also the use of silicon as a deoxidizing agent is undesirable for producing the Drawing Quality steel of the present invention since it imparts a hardness to the steel which may adversely effect its drawability. Theoretically, this problem could perhaps be overcome if higher temperature heat zones and slower line speeds were employed in the continuous annealing process. However, modification of existing continuous annealing apparatus to achieve that end would not be feasible, particularly since it would result in decreased production as well as maintenance problems due to the requirement of slower line speeds and increased heat.

The discovery of the present invention is that the above problem may be overcome through the composition of the steel and without requiring modification of existing commercial continuous annealing apparatus. It has been discovered that in order to achieve proper grain size and other physical properties required by Drawing Quality steel, the steel must have exceedingly low carbon and aluminum contents, namely less than 0.02% carbon and less than 0.023% aluminum and preferably less than 0.015% aluminum. Moreover, in instances where the steel is to be used for making galvanized sheet, silicon should not be included in the deoxidizing additives since it would render the steel too hard for Drawing Quality applications.

OBJECTS OF INVENTION

It is therefore an object of the present invention to produce Drawing Quality steel through continuous casting in a manner suitable for commercial production while overcoming the above-noted problem of achieving the proper grain size. Included herein is the production of Drawing Quality steel through the use of continuous casting to obtain increased production efficiency when compared to ingot-to-slab production. Further included herein is the production of Drawing Quality steel utilizing existing or conventional continuous casting and annealing apparatus without requiring modification of the same or decreasing the rate of production.

A further object of the present invention is the provision of a novel Drawing Quality steel composition highly suitable for continuous casting. Included herein is the provision of such a steel highly suitable for galvanized sheet now being used in the automobile industry and wherein the galvanized sheet may be formed in a continuous galvanizing line. More specifically included herein is the provision of such a steel having a novel composition containing less than 0.023% aluminum and preferably less than 0.015% aluminum, less than 125 parts per million oxygen and preferably less than 100 parts per million oxygen and less than 0.02% carbon.

A still further object of the present invention is to provide a novel process for producing a deoxidized steel having the low carbon, aluminum and oxygen contents described above and which moreover, may be continuously cast to achieve the objects stated above.

Another object of the present invention is to provide a novel non-silicon bearing additive agent including both carbon and aluminum to be introduced to molten steel during vacuum degassing for deoxidation purposes without excessively recarburizing the steel or raising the aluminum content so as to leave the steel suitable for continuous casting for use in producing Drawing Quality galvanized sheet.

SUMMARY OF INVENTION

Drawing Quality steel in accordance with the present invention contains exceedingly low carbon, aluminum, and oxygen contents. Such contents are less than 0.02% carbon in a range of 0.005% to 0.02%; less than 0.023% aluminum and preferably less than 0.015% aluminum; and less than 125 parts per million oxygen and preferably below 100 parts per million oxygen. In addition, the steel contains low silicon, less than 0.015%; and manganese of at least 0.20% and not greater than 0.35%. In addition, the steel contains less than 0.015% phosphorus, less than 0.025% sulfur and less than .0040% nitrogen.

According to the process of the present invention, a heat of steel at 2,960° F. is prepared with the lowest possible carbon content, for example, less than 0.035% carbon when using the basic oxygen process, which is preferred. A manganese addition in the form of ferromanganese is introduced into the ladle to increase the manganese content of the steel so that at the conclusion of the process, the manganese content will be at least 0.20% and not greater than 0.35%. As is well-known, the manganese imparts toughness quality to the steel. At the same time of the manganese addition, an aluminum addition is also made solely for purposes of controlling the oxygen content through deoxidation and thereby prevent a boiling which can damage parts in the ladle such as the refractory sleeves of the stopper rods which close the openings in the bottom of the ladle. The aluminum added at this stage is consumed in the deoxidation process so that the aluminum content of the steel is not increased after deoxidation at this stage in the process; the aluminum content at this stage, in one example being about 0.005%.

The steel is then taken to a vacuum degassing unit such as a Dortmund-Hörder (D-H) or Ruhrstahl-Heraeus (R-H), the latter being preferred, where it is degassed for a period of time during which a non-silicon bearing additive of both carbon and aluminum are introduced into the steel for deoxidation purposes. The amount of aluminum added is specifically limited so as to keep the resulting aluminum content in the steel below 0.023% and preferably below 0.015%. More carbon than aluminum is added to compensate for the limited aluminum addition in the deoxidation process where carbon unites with oxygen to form carbon monoxide. However, the amount of carbon is also limited so as not to excessively recarburize the steel and to keep the carbon content below 0.02%. In this way, the reduction of oxygen to less than 125 parts per million and preferably less than 100 parts per million is achieved and at the same time the carbon content is kept below 0.02% and the aluminum preferably below 0.015% thus permitting Drawing Quality steel to be continuously cast for producing a continuously annealed (galvanized) sheet with proper grain size of 8 or 9.

In one specific preferred embodiment, the carbon and aluminum addition is in the form of briquettes also including ferromanganese as a sinker with the remainder constituting a binder substance. The manganese content of the steel after degassing is not greater than 0.35% and is derived from the addition of the manganese prior to the degassing step; the being understood that the ferromanganese sinker included in the addition during the degassing step makes up for the loss of manganese in the steel during the degassing. Thus, the manganese content is limited so as not to exceed 0.35% for otherwise it would adversely effect the Drawing Quality of the steel in a continuously annealed product. It is further noted in contrast to the prior art, that silicon is specifically excluded from the additive agent so that the silicon content is kept low, below 0.015% so as not to render the steel too hard for Drawing Quality applications. The Drawing Quality thus prepared may be continuously cast into slabs then rolled into sheet, and continuously annealed and galvanized.

DETAILED DESCRIPTION OF INVENTION

Drawing Quality steel is used in industry to designate a sheet steel having high as well as uniform, drawability. Drawing Quality steel is used herein to designate the steel of the present invention which possesses exceedingly high or maximum drawability as well as uniformity. The foregoing properties of the steel of the present invention may be measured by its plastic strain ratio ($\bar{r}$) which lies in a range of approximately 1.2 to 1.4. The plastic strain ratio is a measure of drawability, and it is the ratio of the width strain to the thickness strain when the steel is subjected to tension. The higher the ratio ($\bar{r}$), the better the drawability. The steel of the present invention is to be contrasted with rimmed steel which exhibits a lower plastic strain ratio ($\bar{r}$) characteristic; it being understood that rimmed steel is commonly used in producing other forms of Drawing Quality steel.

While certain killed steels may possess high drawability characteristics, the steel of the present invention is to be distinguished from the latter in that the aluminum content of the steel of the present invention is preferably below 0.015%, whereas aluminum-killed steels possess aluminum contents above 0.025%, thus creating the aforementioned problem in achieving the required grain size A.S.T.M. 8 or 9 when subjected to a continuous casting and galvanizing process. In contrast, the steel of the present invention is highly suitable for continuous casting and the production of galvanized sheet of A.S.T.M. grain size 8 or 9 in a continuous galvanizing line of the continuous anneal type. For a more detailed description of various continuous galvanizing process, reference may be had to THE MAKING, SHAPING AND TREATING OF STEEL by Harold E. McGannon, Ninth Edition, Chapter 37, Section 4, pages 1037 to 1041.

The Drawing Quality steel of the present invention is a low carbon steel wherein the carbon content is less than 0.02% in the range of 0.005% to 0.02%, the aluminum content is below 0.023% and preferably below 0.015%; and the oxygen content is below 125 parts per million and preferably below 100 parts per million. In addition, the steel contains low silicon, for example, less than 0.015%; manganese in a range of 0.20 to 0.35%; less than 0.015% phosphorus; less than 0.025% sulfur; less than .0040% nitrogen, with the remainder of course being iron. The grain size is of the order of 8 or 9 using the A.S.T.M. micrograin size scale under A.S.T.M. designation E 112. To give an example under this designation, the calculated diameter of the average grain of a metal having an 8 grain size would be in the range of 0.0200 to 0.0224 mm. or 0.000787 to 0.000884 inches. This steel composition is highly suitable for continuous casting in the production of galvanized sheet of the type now being used, for example, in the automotive industry. The above-described percentages of composition and those to be described below are in terms of weight unless otherwise indicated.

In accordance with the preferred process of the invention, a 300-ton heat of low carbon steel at 2,960° F. and of the lowest possible carbon content, for example, less than 0.035% carbon is prepared using the basic oxygen process (BOP) which is well-known and needs no description here. While the heat may be prepared from other processes such as utilize open hearth or electric furnaces, the basic oxygen process is preferred. For a detailed description of oxygen-blown steel making processes, reference may be had to THE MAKING, SHAPING AND TREATING OF STEEL by Harold E. McGannon, Ninth Edition, Chapter 16, Section 5, pages 486 to 497 which are hereby incorporated herein by reference.

During the tap, manganese is added to the ladle to increase the manganese content of the steel to impart toughness thereto. However, for Drawing Quality steel, the manganese content should not be excessive for otherwise it would adversely effect the drawability of the steel. Thus, the manganese content in accordance with the present invention is limited so as not to exceed 0.35%. The minimum manganese content is 0.20%.

In the preferred embodiment, the manganese is added in the form of regular ferromanganese and medium-carbon ferromanganese in order to control and minimize the carbon content of the steel. Regular ferromanganese contains approximately 6½% carbon, while medium carbon ferromanganese contains 1½% carbon. Therefore from a theoretical standpoint, it may be preferably to employ only the medium-carbon ferromanganese since it would introduce less carbon into the steel. However, from a practical standpoint use of both as described is preferred since regular ferromanganese is more available and considerably less expensive.

Together with the above manganese addition, aluminum is introduced into the ladle solely for purposes of controlling the oxygen through deoxidation to thereby prevent excessive boiling of the heat which otherwise could cause damage to the refractory parts in the ladle as well as to the vacuum degassing unit in which the steel is subsequently processed as will be described. However, the aluminum added is in small quantities so as to be completely consumed in the deoxidation process so that the aluminum content in the steel after deoxidation at this stage is not increased but remains at less than 0.015%. In the preferred process, 100 pounds of aluminum "notch-bar" (metallic aluminum) is added to a 300-ton heat of steel prepared by the basic oxygen process. Also in this embodiment, 1,100 pounds of regular ferromanganese and 1,100 pounds of medium-carbon ferromanganese are added together with the 100 pounds aluminum.

The steel is then taken to a vacuum degassing unit where it is subjected for approximately 15 minutes to vacuum degassing during which the steel undergoes deoxidation. Any conventional vacuum degassing unit and process may be employed such as the Dortmund-Hörder (D-H process and the Ruhrstahl-Heraeus (R-H) process which are well-known. In these processes of which the R-H is preferred, the molten steel is subjected to a vacuum in an evacuated vessel for a sufficient period of time to evolve the gases and for the gases to be removed by a vacuum connection. For a more detailed description of vacuum degassing of steel, including the Dortmund-Hörder and Ruhrstahl-Heraeus processes, reference may be had to THE MAKING, SHAPING AND TREATING OF STEEL noted above in Chapter 19, Section 4, pages 591 through 598 which are hereby incorporated herein by reference.

At this point during the vacuum degassing process, an additive including carbon and aluminum is introduced into the steel in certain specific amounts and at a controlled rate in order to remove further amounts of oxygen through deoxidation to reduce the oxygen content below 125 parts per million and preferably below 100 parts per million. In the deoxidation process the carbon and aluminum respectively unite with oxygen to form carbon monoxide and aluminum oxide.

In the preferred mode of the invention, 400 pounds of graphite carbon and 300 pounds of aluminum shot or wire are added for a 300-ton heat of steel. Furthermore, in the preferred practice of the invention, they are mixed in briquette form which also contains 25% of ferromanganese and 5% of any suitable binder substance. 40% of the briquettes is constituted by the graphite carbon while 30% is constituted by the aluminum shot or wire. Since carbon graphite and aluminum are light, the ferromanganese is used as a "sinker" to provide sufficient weight to ensure that the briquettes will sink into the steel. For a 300-ton heat 1,000 pounds of such birquettes are introduced during vacuum degassing at a controlled rate of 200 pounds per minute.

In contrast to deoxidizing agents of the prior art which include aluminum and/or silicon, it is noted that silicon is specifically excluded in the addition agent of the present invention, since it would render the steel too hard for Drawing Quality applications. In addition, and in accordance with the present invention, a lesser amount of aluminum is added to the steel so as to keep the resulting aluminum content of the steel below 0.023% and preferably below .015%. Furthermore, the amount of carbon added is such as to compensate, in the deoxidation process, for the limited amounts of aluminum added. However, the amount of carbon added is also specifically limited so as not to excessively recarburize the steel but rather to arrive at a carbon content of less than 0.02%. It is important in the production of Drawing Quality steel utilizing continuous casting, that the carbon and aluminum contents be below the amounts indicated for otherwise it is difficult to achieve the proper grain size of 8 or 9 required by Drawing Quality steel produced in a continuous galvanizing unit. At the same time, the additive of the present invention provides sufficient deoxidation so as to lower the oxygen content to less than 125 parts per million and preferably less than 100 parts per million which is also required to avert formation of blow holes of the continuously cast slab which result in surface defects of the sheet product.

After the last portion of the addition agent is introduced into the steel, the vacuum degassing is continued for approximately 5 minutes. In one specific example to the described below, introduction of the addition agent during the vacuum degassing takes approximately 5 minutes so that the total time to which the steel is vacuum degassed is approximately 25 minutes.

After degassing the steel at a temperature of 2,890° F. the steel is cast continuously into slabs and then rolled into sheet in conventional fashion. Then the sheet may be continuously annealed and galvanized by conventional and well-known methods and apparatus. For a detailed description of typical continuous anneal and sheet galvanizing processes, reference may again be had to THE MAKING, SHAPING AND TREATING OF STEEL, above cited, Chapter 33, page 977, and Chapter 37, Section 3, pages 1036 to 1041; the latter pages being hereby incorporated by reference in this specification.

EXAMPLE

The present invention is further illustrated by way of a specific example wherein a 300-ton heat of steel is prepared by the basic oxygen process and is at a temperature of 2,960° F. The steel is prepared with the lowest possible carbon content which, in this example, is 0.035%. In addition, the steel, as prepared, contains 0.10% manganese, 0.006% phosphorus, 0.018% sulfur, 0.005% silicon, 0.005% aluminum, and 700 parts per million oxygen. This heat of steel is tapped into a ladle and added to the ladle is 1,100 pounds of regular ferromanganese, 1,100 pounds of medium carbon ferromanganese, and 100 pounds of metallic aluminum.

Analysis of the steel in the ladle after the above addition reveals the following composition: 0.045% carbon, 0.33% manganese, 0.006% phosphorus, 0.018% surfur, 0.01% silicon, 0.005% aluminum, and 600 parts per million oxygen.

The steel, at a temperature of 2,920° F., is then taken to an R-H unit and vacuum degassed for 15 minutes. At this point, the steel when analyzed contains the following composition: 0.015% carbon, 0.30% manganese, 0.006% phosphorus, 0.018% sulfur, 0.01% silicon, 0.005% aluminum, and 350 parts per million oxygen.

At this stage during vacuum degassing, 1,000 pounds of graphite-aluminum-ferromanganese briquettes are added to the steel from an overhead hopper by a weigh-feeder and at a specific controlled rate of 200 pounds per minute. The composition of the briquettes is: 40% graphite carbon, 30% aluminum in the form of shot or wire, 25% ferromanganese (sinker), and 5% binder.

After the conclusion of the above briquette addition, the steel is subject to continued vacuum degassing for 5 minutes, making the total vacuum degassing treatment time in the R-H unit 25 minutes.

The steel temperature in the ladle as it is ready to be transported to the continuous slab casting unit is 2,890° F. suitable for proper continuous casting. The final analysis of the cast steel product reveals the following composition: 0.018% carbon, 0.31% manganese, 0.006% phosphorus, 0.018% surfur, 0.013% silicon, 0.022% aluminum, and 110 parts per million oxygen. The steel is then rolled into sheet, then subject to a continuous anneal process and then galvanized.

What is claimed is:

1. A process for producing drawing quality steel having an exceedingly low carbon, aluminum and oxygen contents and consisting essentially of less than 0.02% carbon, less than 0.023% aluminum, less than 125 parts per million oxygen, less than 0.015% silicon, 0.20% to 0.35% manganese and the remainder iron and incidental impurities, the process comprising the steps of; preparing a heat of steel consisting essentially of not greater than 0.035% carbon, oxygen in an amount greater than 350 parts per million, less than 0.015% silicon, less than 0.20% manganese and the remainder iron and incidential impurities, adding to the heat a manganese addition to increase the manganese content of the steel in the range of 0.20% to 0.35%, vacuum degassing the molten steel, during vacuum degassing adding a non-silicon bearing deoxidizing agent consisting essentially of carbon, aluminum and the remainder binder and sinker substances and continuing the vacuum degassing after this addition, and wherein the amounts of carbon and aluminum added are limited such that the resulting steel after the vacuum degassing will contain carbon in an amount less than 0.02% and aluminum in an amount less than 0.023% while at the same time being sufficient to reduce the amount of oxygen to less than 125 parts per million.

2. The process defined in claim 1 wherein the deoxidizing agent consists essentially of 40% carbon and 30% aluminum and the remainder sinker and binder substances.

3. The process defined in claim 2 wherein 3⅓ pound of said deoxidizing agent are addedfor each ton of steel.

4. The process defined in claim 3 wherein the deoxidizing agent is introduced at a rate of 200 pounds per minute for a 300-ton heat of steel.

5. The process defined in claim 2 further including the steps of adding metallic aluminum together with the manganese prior to the vacuum degassing step to control the oxygen in the heat through deoxidation to prevent excessive boiling caused by the oxygen, with the proviso that the amount of aluminum added being entirely consumed in deoxidation so that the aluminum content of the steel after deoxidation remains substantially the same as that before the addition of aluminum.

6. The process defined in claim 5 wherein the aluminum content in the steel when the heat is prepared is about 0.005%.

7. The process defined in claim 5 wherein the carbon content of the steel after the addition of manganese and aluminum all prior to the degassing step is about 0.045% and during degassing just prior to addition of said deoxidizing agent is approximately 0.015%.

8. The process defined in claim 7 wherein the steel as initially prepared contains manganese in an amount of about 0.10%, and oxygen in an amount of 700 parts per million, and after the addition of aluminum and manganese contains about 0.33% manganese and about 600 parts per million oxygen, and during the degassing step just prior to introduction of said deoxidizing agent contains about 0.30% manganese and 350 parts per million oxygen.

9. The process defined in claim 8 wherein said impurities of the steel at the conclusion of the process consist essentially of less than 0.015% phosphorus, and less than 0.025% sulfur.

10. The process defined in claim 5 wherein the steel as initially prepared contains 0.10% manganese, 700 parts per million oxygen, and the steel after the addition of the aluminum and manganese contains 0.33% manganese and 600 parts per million oxygen, and the steel during the degassing step just prior to introduction of said deoxidizing agant contains 0.30% manganese and 350 parts per million oxygen.

11. The process defined in claim 10 wherein the aluminum content in the heat of steel at the start of the process is 0.005% and remains the same after the addition of aluminum and manganese prior to the degassing step, and wherein after the addition of said deoxidizing agent the aluminum content is 0.022%.

12. The process defined in claim 11 wherein the manganese addition includes ferromanganese and after the addition of said deoxidizing agent the steel consists essentially of 0.018% carbon, 110 parts per million oxygen, 0.013% silicon, 0.31% manganese, 0.22% aluminum and the remainder iron and incidental impurities.

* * * * *